US005202376A

United States Patent [19]

Coates et al.

[11] Patent Number: 5,202,376

[45] Date of Patent: Apr. 13, 1993

[54] SOLUTIONS FOR FLASH-SPINNING DRY POLYMERIC PLEXIFILAMENTARY FILM-FIBRIL STRANDS

[75] Inventors: Don M. Coates, Midlothian; Gary S. Huvard, Quinton, both of Va.; Hyunkook Shin, Wilmington, Del.

[73] Assignee: E. I. Du Pont de Nemours and Company, Wilmington, Del.

[21] Appl. No.: 693,851

[22] Filed: May 2, 1991

Related U.S. Application Data

[60] Division of Ser. No. 382,092, Jul. 24, 1989, Pat. No. 5,043,109, which is a continuation-in-part of Ser. No. 238,639, Aug. 30, 1988, abandoned, which is a continuation of Ser. No. 378,177, Jul. 14, 1989, abandoned.

[51] Int. Cl.[5] ..... C08K 5/00

[52] U.S. Cl. ..... 524/583; 524/585

[58] Field of Search ..... 524/583, 585

[56] References Cited

U.S. PATENT DOCUMENTS

| | | | |
|---|---|---|---|
| 3,081,519 | 3/1963 | Blades et al. | 28/81 |
| 3,227,794 | 1/1966 | Anderson et al. | 264/205 |
| 4,352,650 | 10/1982 | Marshall | 425/174.8 |
| 4,554,207 | 11/1985 | Lee | 428/288 |

FOREIGN PATENT DOCUMENTS

| | | |
|---|---|---|
| 891943 | 3/1962 | United Kingdom . |
| 891945 | 3/1962 | United Kingdom . |

OTHER PUBLICATIONS

P. S. Zurer, "Search Intensifies for Alternatives to Ozone-Depleting Halocarbons", Chem. & Eng. News, pp. 17-20 (Feb. 8, 1988).

*Primary Examiner*—John C. Bleutge
*Assistant Examiner*—Mark Sweet

[57] ABSTRACT

Solutions for flash-spinning substantially dry plexifilamentary film-fibril strands from fiber-forming polyolefins. The solutions comprise a mixture of 18 to 33 percent polyolefin by weight of the solution, 42 to 73 percent methylene chloride by weight of the solution and 9 to 25 percent carbon dioxide by weight of the solution.

3 Claims, No Drawings

SOLUTIONS FOR FLASH-SPINNING DRY POLYMERIC PLEXIFILAMENTARY FILM-FIBRIL STRANDS

This is a division of application Ser. No. 07/382,092, filed Jul. 24, 1989 which is a continuation-in-part of application Ser. No. 07/238,639 filed Aug. 30, 1988, now abandoned, which is a continuation of application Ser. No. 07/378,177 filed Jul. 14, 1989, now abandoned.

BACKGROUND OF THE INVENTION

1. Field of the Invention

This invention relates to a process for flash-spinning substantially dry polymeric plexifilamentary film-fibril strands. More particularly, the invention concerns an improved process in which a substantially dry strand is flash-spun from mixtures of fiber-forming polyolefin, methylene chloride and carbon dioxide.

2. Description of the Prior Art

Blades and White, U.S. Pat. No. 3,081,519, and British Patents 891,943 and 891,945 describe flash-spinning plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash spinning causes the liquid to vaporize and thereby cool the exudate which forms a plexifilamentary film-fibril strand of the polymer. Preferred polymers include crystalline polyhydrocarbons such as polyethylene and polypropylene.

According to U.S. Pat. Nos. 3,081,519, 891,943 and U.S. Pat. No. 891,945 the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as methylene chloride, carbon tetrachloride, chloroform, ethyl chloride, methyl chloride; alcohols; esters; ethers; ketones; nitriles; amides; fluorocarbons; sulfur dioxide; carbon disulfide; nitromethane; water; and mixtures of the above liquids. The patent further states that the flash-spinning solution additionally may contain a dissolved gas, such as nitrogen, carbon dioxide, helium, hydrogen, methane, propane, butane, ethylene, propylene, butane, etc. Preferred for improving plexifilament fibrillation are the less soluble gases, i.e., those that dissolve to a less than 7% concentration in the polymer solution under the spinning conditions. In Example VI of U.S. Pat. No.3,081,519, which provides the only exemplification of methylene chloride and carbon dioxide as the flash-spinning medium, a 13% solution of linear polyethylene in methylene chloride is saturated with carbon dioxide at 200° C. at a total equilibrium pressure of 1,000 psi and then flash spun at 1060 psi. The dissolved carbon dioxide concentration was 3.7%.

Trichlorofluoromethane (Freon-11) has been a very useful solvent for commercial manufacture of plexifilamentary film-fibril strands of polyethylene. However, the escape of such a halocarbon into the atmosphere has been implicated as a serious source of depletion of the earth's ozone. A general discussion of the ozone-depletion problem is presented, for example, by P. S. Zurer, "Search Intensifies for Alternatives to Ozone-Depleting Halocarbons", *Chemical & Engineering News*, pages 17–20 (Feb. 8, 1988). The substitution of methylene chloride for trichlorofluoromethane in the commercial flash-spinning process should avoid the ozone depletion problem.

This invention provides a process for flash-spinning substantially dry polymeric plexifilamentary film-fibril strands from spin mixtures of methylene chloride, carbon dioxide and fiber-forming polyolefin.

SUMMARY OF THE INVENTION

The present invention provides an improved process for flash-spinning polymeric plexifilamentary film-fibril strands, wherein a spin mixture is formed comprising methylene chloride, fiber-forming polyolefin and carbon dioxide which is then flash-spun at a pressure that is greater than the autogenous pressure of the spin mixture into a region of substantially lower temperature and pressure, the improvement for producing substantially dry strands comprising, in combination, the carbon dioxide amounting to 9 to 25 percent by weight of the spin mixture, the polyolefin amounting to 18 to 33 percent by weight of the spin mixture and the methylene chloride amounting to 42 to 73 percent by weight of the spin mixture, the mixing of the polyolefin and the flash-spinning being performed at a temperature in the range of 130 to 220° C..

The present invention also includes novel solutions comprising 18 to 33 percent fiber-forming polyolefin by weight of the spin mixture, 42 to 73 percent methylene chloride by weight of the spin mixture and 9 to 25 percent carbon dioxide by weight of the spin mixture.

DETAILED DESCRIPTION OF PREFERRED EMBODIMENTS

The term "polyolefin" as used herein, is intended to mean any of a series of largely saturated open chain polymeric hydrocarbons composed only of carbon and hydrogen. Typical polyolefins include, but are not limited to, polyethylene, polypropylene, polymethylpentene and various combinations of the monomers ethylene, propylene, methylpentene.

The term "polyethylene" is intended to embrace not only homopolymers of ethylene, but also copolymers wherein at least 85% of the recurring units are ethylene units. The preferred polyethylene is a homopolymeric linear Polyethylene which has an upper limit of melting range of about 130 to 135° C., a density in the range of 0.94 to 0.98 g/cm$^3$ and a melt index (as defined by ASTM D-1238-57T, Condition E) of 0.1 to 6.0.

The term "polypropylene" is intended to embrace not only homopolymers of propylene but also copolymers wherein at least 85% of the recurring units are propylene units.

The term "plexifilamentary film-fibril strand", as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail by Blades and White, U.S. Pat. No. 3,081,519 and by Anderson and Romano, U.S. Pat. No. 3,227,794.

The present invention provides an improvement in the known process disclosed for producing plexifilamentary film-fibril strands by flash-spinning a spin mixture of fiber-forming polyolefin in methylene chloride and carbon dioxide to produce substantially dry polymeric plexifilimentary film-fibril strands. The process of the present invention requires the flash-spinning to be performed with a spin mixture comprising 18 to 33 weight percent of the total spin mixture of fiber-forming polyolefin, 42 to 73 weight percent of the total spin mixture of methylene chloride and 9 to 25 weight percent of the total spin mixture of carbon dioxide.

Under the process conditions of this invention as described above, the flash-spun strand is dry or substantially dry as it emerges from the spinneret. That is, the "as-spun" strand is substantially free of methylene chloride. This is particularly so in comparison with U.S. Pat. No. 3,081,519, Example VI referenced above wherein a strand spun from a mixture of with 3.7% carbon dioxide, 13% polyethylene and methylene chloride is wet to the touch with methylene chloride when spun.

There are several significant advantages of having a dry or substantially dry strand emerging from the spinneret. The movement of substantially dry strands, such as in sheet formation, may be more easily managed by natural aerodynamic flows than can the movement of wet strands. Devolatilization of solvent residuals is more easily performed on the substantially dry strands. Wet strands tend to cling to, and wrap around the rollers used to consolidate the strands into sheet structures; an occurrence that cannot be tolerated in a commercial production facility. Finally, spin temperature can be lowered as less methylene chloride must be vaporized. Lower spin temperatures than those disclosed in U.S. Pat. No. 3,081,519 are desirable for reducing the degradation of the solvent, methylene chloride.

The preferred fiber-forming polyolefins for use in the present invention are polyethylene and polypropylene as disclosed in U.S. Pat. No. 3,081,519. Polyolefin concentrations of 18 to 33 percent by weight of the spin mixture are employed.

Carbon dioxide is present in the spin mixture in concentrations ranging from 9 to 25 percent. Generally, in order to spin dry strands from the spin mixtures of this invention, lower concentrations of polyolefin require more carbon dioxide in the spin mixture. The Practice of this invention requires a reasonable combination of methylene chloride, carbon dioxide and polyolefin depending on the composition of the mixture, and temperature and pressure.

The required temperatures for preparing the spin mixture and for flash-spinning the mixture are usually about the same and usually are in the range of 130° to 220° C..

The mixing and the flash-spinning are performed at a pressure that is higher than the autogenous pressure of the mixture. The pressure during the spin mixture preparation is usually at least 800 psia and usually no higher than 2,500 psia, though pressures as high as about 8,000 psia can be used. The flash-spinning pressure is usually at least 600 psia though somewhat higher spin pressures are often employed.

The spin mixture preferably comprises fiber-forming polyolefin, methylene chloride and carbon dioxide However, conventional flash-spinning additives can be incorporated into the spin mixtures by known techniques. These additives can function as ultraviolet-light stabilizers, antioxidants, fillers, dyes, and the like.

The novel solutions of this invention comprise to 33 weight percent fiber-forming polyolefin, 42 to weight percent methylene chloride and 9 to 25 weight percent carbon dioxide. The preferred fiber-forming polyolefins are polyethylene and polypropylene.

EXAMPLES

The invention is illustrated in all the Examples which follow with batch processes, sometimes in equipment of relatively small size. Such batch processes can be scaled-up and converted to continuous flash-spinning processes that can be performed, for example, in the type of equipment disclosed by Anderson and Romano, U.S. Pat. No. 3,227,794. Polyethylene is the polymer conveniently employed in the examples.

Equipment

The plexifilamentary strands for Examples 1, 2, 3 and 4 were prepared in equipment that comprises an autoclave of 5-gallon capacity which is equipped with a motor-driven, close fitting, spiral blade agitator, temperature and pressure measuring devices, heating means and inlets for loading the necessary ingredients into the autoclave. An exit line from the autoclave is connected through a quick-acting valve to a spin assembly of the type disclosed by Marshall, U.S. Pat. No. 4,352,650, the entire disclosure of which is hereby incorporated herein by reference. The spin assembly included a pressure let-down orifice of 0.072, 0.068 or 0.062-inch diameter, which leads to a let-down chamber of 5.5 inch length followed by a spin orifice of 0.064, 0.058 or 0.046-inch diameter, and then a "tunnel" of 0.27-inch length, 0.33-inch entrance diameter and 0.45-inch exit diameter.

Methodology

For Examples 1, 2 and 3 the autoclave was loaded with high density linear polyethylene of 0.76 melt index and methylene chloride. The autoclave was closed, evacuated and moderate-speed agitation was begun. Carbon dioxide was added to the autoclave and heating was begun. When the temperature of the contents of the autoclave reached 140° C., the internal pressure was increased to 1,500 psia by adding more carbon dioxide. The addition of the carbon dioxide caused significant pressure and temperature fluctuations and accordingly pressure was allowed to stabilize for 15 minutes after each carbon dioxide addition. The pressure dropped as the carbon dioxide dissolved in the methylene chloride polyethylene mixture. The autoclave was then repeatedly re-pressurized to 1,800 psia with carbon dioxide until saturation was judged to have been achieved. This was indicated by a steady pressure of 1,800 psia being maintained in the autoclave. The temperature of the autoclave was then maintained at 150° C.. The total time of heating and mixing, counting from the time the autoclave temperature reached 140° C., was about one hour. Then the rotation speed of the agitator blade was reduced to about ⅓ of its initial speed and the autoclave pressure was rapidly adjusted, if needed, to 1,800 psia with nitrogen, followed by prompt opening of the exit valve to permit the spin mixture to flow to the spin assembly, which also had been heated to 150° C.. The results are shown in Table I.

For Example 4, the autoclave was loaded with high density linear polyethylene of the type used before. The autoclave was closed, evacuated and the methylene chloride added. Then the desired amount of carbon dioxide was added under pressure by use of a pump.

The agitation was started using moderate speed temperature of 170° C. for one hour, timed when first at 50° C.. The mixer was slowed to about ⅓ of its initial speed and the autoclave pressure rapidly adjusted as needed to 1,800 psi with nitrogen or venting. Finally, prompt opening of the exit valve to the spin assembly allowed spinning of the mixture.

TABLE I

| | Example No. | | | |
|---|---|---|---|---|
| | 1 | 2 | 3 | 4 |
| Spin mixture | | | | |
| Polyethylene | | | | |
| Conc, wt % | 22.1 | 20.9 | 20.4 | 25.0 |
| $CO_2$, wt % | 17.5 | 13.1 | 15.4 | 12.0 |
| $CH_2Cl_2$, wt % | 60.4 | 66.0 | 64.2 | 63.0 |
| Mixing | | | | |
| Temp, °C. | 150 | 150 | 150 | 170 |
| Press, psia | 1800 | 1800 | 1800 | 1800 |
| Spinning | | | | |
| Temp, °C. | 150 | 150 | 150 | 170 |
| Press, psia | 1100 | 1100 | 1100 | 1100 |
| Strand Product | DRY | DRY | DRY | DRY |

EXAMPLES 5, 6 and A and B

Methodology

For Examples 5 and 6 and Controls A and B, the autoclave was first loaded with a pre-weighed quantity of high density, linear polyethylene pellets of 0.76 melt index. The autoclave was closed and air was evacuated to a final pressure below 1 psia (typically at room temperature and moderate agitation begun to suspend the polyethylene pellets. The total charge of carbon dioxide was then charged to the autoclave at room temperature and heating of the autoclave contents started. Typically, the autoclave was heated to about 150° C. over about 45 minutes and then held at the temperature with agitation for another 30 minutes. During this period, the polyethylene melted and dissolved in the methylene chloride/carbon dioxide mixture The polymer solution thus formed was then heated to the final desired temperature and again held for approximately 30 minutes with agitation to insure homogeneity.

The total charge of polyethylene, methylene chloride and carbon dioxide was chosen such that a pressure of between 1800 and 1900psia was hydraulically generated by the polymer solution upon heating the vessel contents to the final desired temperature. At this hydraulically full condition and pressure range, the polyethylene, methylene chloride and carbon dioxide form a single, homogeneous solution in which all components are intimately and thoroughly mixed. No gas or vapor bubbles exist in the solution.

Once the solution has been formed and the final temperature and pressure obtained, the agitation is turned off and nitrogen, at the same pressure as the solution in the vessel, is introduced to the head of the vessel. Release of the solution through a spinneret is then immediately commenced. Without agitation and over the short time scale of contact between the nitrogen and the solution, little or no transfer of nitrogen to the polymer solution takes place. The nitrogen therefore acts as a "gas piston" to maintain the pressure on the solution during spinning. Depending on the spinneret from 1.5 to 3 minutes. The results are summarized in Table II.

TABLE II

| | Example No. | | | |
|---|---|---|---|---|
| | 5 | 6 | A | B |
| Spin mixture | | | | |
| Polyethylene | | | | |
| Conc, wt % | 18 | 32 | 12 | 25 |
| $CO_2$, wt % | 15 | 10 | 4.5 | 7.5 |
| $CH_2Cl_2$, wt % | 67 | 58 | 83.5 | 67.5 |
| Mixing | | | | |
| Temp, °C. | 185 | 210 | 170 | 170 |
| Press, psia | 1800 | 1800 | 1800 | 1800 |
| Strand Product | DRY | DRY | WET | WET |

We claim:

1. A solution particularly useful for flash-spinning substantially dry polymeric plexifilamentary film-fibril strands, comprising 18 to 33 percent fiber-forming polyolefin by weight of the solution, 42 to 73 percent methylene chloride by weight of the solution and 9 to 25 percent carbon dioxide by weight of the solution.

2. A solution particularly useful for flash-spinning substantially fry polymeric plexifilamentary film-fibril strands, comprising 18 to 33 percent polyethylene by weight of the solution, 42 to 73 percent methylene chloride by weight of the solution and 9 to 25 percent carbon dioxide by weight of the solution.

3. A solution particularly useful for flash-spinning substantially dry polymeric plexifilamentary film-fibril strands, comprising 18 to 33 percent polypropylene by weight of the solution, 42 to 73 percent methylene chloride by weight of the solution and 9 to 25 percent carbon dioxide by weight of the solution.

* * * * *